US011629487B2

(12) United States Patent
Guthrie et al.

(10) Patent No.: US 11,629,487 B2
(45) Date of Patent: Apr. 18, 2023

(54) ROLLER-DRIVEN TRIP LEVER WITH CLUTCH ASSEMBLY

(71) Applicant: Lavelle Industries, Inc., Burlington, WI (US)

(72) Inventors: Kevin J. Guthrie, Wind Lake, WI (US); Jordan Smith, Waukesha, WI (US)

( * ) Notice: Subject to any disclaimer, the term of this patent is extended or adjusted under 35 U.S.C. 154(b) by 186 days.

(21) Appl. No.: 17/153,483

(22) Filed: Jan. 20, 2021

(65) Prior Publication Data

US 2021/0222414 A1 Jul. 22, 2021

Related U.S. Application Data

(60) Provisional application No. 62/963,409, filed on Jan. 20, 2020.

(51) Int. Cl.
*E03D 5/092* (2006.01)

(52) U.S. Cl.
CPC ..... *E03D 5/092* (2013.01)

(58) Field of Classification Search
CPC ..... E03D 1/02–125; E03D 1/14–145; E03D 1/20; E03D 5/003–006; E03D 5/02; E03D 5/026; E03D 5/04–08; E03D 5/09–094; E03D 5/12
See application file for complete search history.

(56) References Cited

U.S. PATENT DOCUMENTS

| | | | | |
|---|---|---|---|---|
| 3,091,775 | A | 6/1963 | Himmelrick | |
| 4,056,856 | A | 11/1977 | Reid et al. | |
| 4,058,858 | A | 11/1977 | Che-Wi | |
| 4,764,995 | A | 8/1988 | Harney | |
| 4,817,216 | A | 4/1989 | Auman | |
| 5,319,809 | A | 6/1994 | Testa | |
| 5,680,659 | A * | 10/1997 | Gessaman | E03D 1/142 4/405 |
| 7,861,330 | B2 * | 1/2011 | Tau | E03D 5/092 4/405 |
| 8,393,018 | B2 | 3/2013 | Huang | |
| 8,418,276 | B2 | 4/2013 | Huang | |
| 9,032,560 | B2 | 5/2015 | Lambert et al. | |
| 9,803,350 | B2 * | 10/2017 | Guthrie | E03D 5/09 |
| 9,834,918 | B2 * | 12/2017 | Veros | E03D 5/026 |
| 10,047,509 | B2 | 8/2018 | Schuster et al. | |
| 2010/0050331 | A1 | 3/2010 | Sim | |
| 2018/0230684 | A1 * | 8/2018 | Han | E03D 5/092 |

FOREIGN PATENT DOCUMENTS

KR 1019800000394 5/1980

* cited by examiner

*Primary Examiner* — David P Angwin
*Assistant Examiner* — Nicholas A Ros
(74) *Attorney, Agent, or Firm* — Amundsen Davis, LLC; Joseph S. Heino; Erin E. Kaprelian

(57) ABSTRACT

An assembly comprises an outer subassembly, a toilet tank, and an inner subassembly. The outer subassembly further comprises a handle, a handle stop, a torsion spring disposed between the handle and the handle stop, and a tank hole seal. The inner subassembly further comprises a mounting plate to receive the outer subassembly. A drive pin is coupled to the mounting plate. The inner subassembly further comprises a flush lever and a roller subassembly.

9 Claims, 5 Drawing Sheets

ROLLER-DRIVEN TRIP LEVER WITH CLUTCH ASSEMBLY

PRIORITY CLAIM

This application claims priority to U.S. Provisional Patent Application No. 62/963,409, filed Jan. 20, 2020, the contents of which are hereby incorporated by reference.

FIELD OF THE INVENTION

The present invention relates generally to plumbing fixtures and to the component parts that are used in them. It also relates to a mechanical structure that allows a user to not control the open and close time of a flapper valve or flush valve canister of the type that are used in gravity flush toilets. It also relates generally to flush levers and flush lever actuation devices. More specifically, the present invention relates to a flush lever with clutch and an assembly for actuating the flush lever with clutch.

BACKGROUND OF THE INVENTION

Conventional toilets typically employ a number of essential components. First, a porcelain water tank is mounted immediately above a porcelain bowl, from which a quantity of water is rapidly drained in order to flush waste from the bowl into a sewer system. One very common design uses a flapper valve made of an elastomeric material that covers the drain outlet of the tank. When the flush handle on the outside of the tank is manually actuated, typically by pushing the handle downwardly, the flapper valve is lifted by means of a flush lever via a chain or other connecting means. This allows the head of water in the tank to drain through the flush valve and the drain outlet. The flapper valve is typically designed with an inverted air chamber so that it initially floats as it is lifted away from the drain outlet in the bottom of the tank. This allows sufficient flushing water to flow into the bowl even if the user immediately releases the flush handle. When the water level in the tank drops, the tank is automatically refilled through a fill valve connected to a water supply line.

Current flush levers used with toilet tanks typically comprise a rotatable handle disposed to the tank exterior, a flush lever disposed within the tank interior, and a mechanical coupling disposed between the rotatable handle and the flush lever. Actuation of the flush lever is accomplished by pushing the end of the rotatable handle downwardly (or rearwardly depending on the handle's orientation), thereby lifting the flush lever about a central pivot point. All of this mechanical action relies essential on gravity, with the flush lever and flapper valve typically being heavier than the flush handle, and on the floatation of the flapper valve within the tank.

In the view of these inventors, there is a need to allow the flush lever and the rotatable handle to be configured such that it can be operated in a way that does not allow the user to control the open and close time of the flapper or canister.

SUMMARY OF THE INVENTION

In accordance with the foregoing, a flush lever with clutch and assembly has been devised by these inventors which accomplishes the goal identified above. As used herein, the term "flush handle" means the handle disposed outside the toilet tank for flush actuation by the user, and the interior "flush lever" means the interior lever that is mechanically coupled to the flush handle and used to open and close the flapper or canister disposed within the toilet tank, typically via a chain or other structure. The mechanical coupling between the flush handle and the flush lever is the "flush lever with clutch" and the flush lever with clutch together with a conventional water tank, for purposes of this disclosure, comprise an "assembly".

More specifically, the flush lever with clutch of the present invention comprises a handle, a handle stop, and a torsion spring, all of which are disposed to the exterior of the tank. Disposed within the tank is a flush lever subassembly comprising means for mechanically linking the flush lever with the handle via the subassembly. The subassembly includes a push rod and roller. Opposite a tank hole seal is a mounting plate, a drive pin, and a lock nut.

The flush lever subassembly comprises a roller assembly, including a roller coupled to a push rod assembly. The roller is disposed such that, when the flush handle is in the home, or neutral, position, the roller is separated from the internal flush lever.

When a user pushes the flush handle, the roller moves downwardly and toward the flush lever, until contact is made between the two. Once contact is made, the flush lever will begin to lift the flapper or canister within the toilet tank. Simultaneously, the roller will continue to move along the flush lever assembly, to the point that a push rod kick ledge contacts the mounting plate kick ledge. The roller comes off the flush lever ramp when the handle is fully depressed. In pushing the flush handle, a torsion spring in the handle is loaded and, upon release of the handle, the torsion spring returns the handle, push rod assembly, and roller assembly to their original positions.

The foregoing and other features of the flush lever with clutch and assembly of the present invention will be apparent from the following detailed description when read in conjunction with the accompanying drawings.

DETAILED DESCRIPTION

Figure 1:
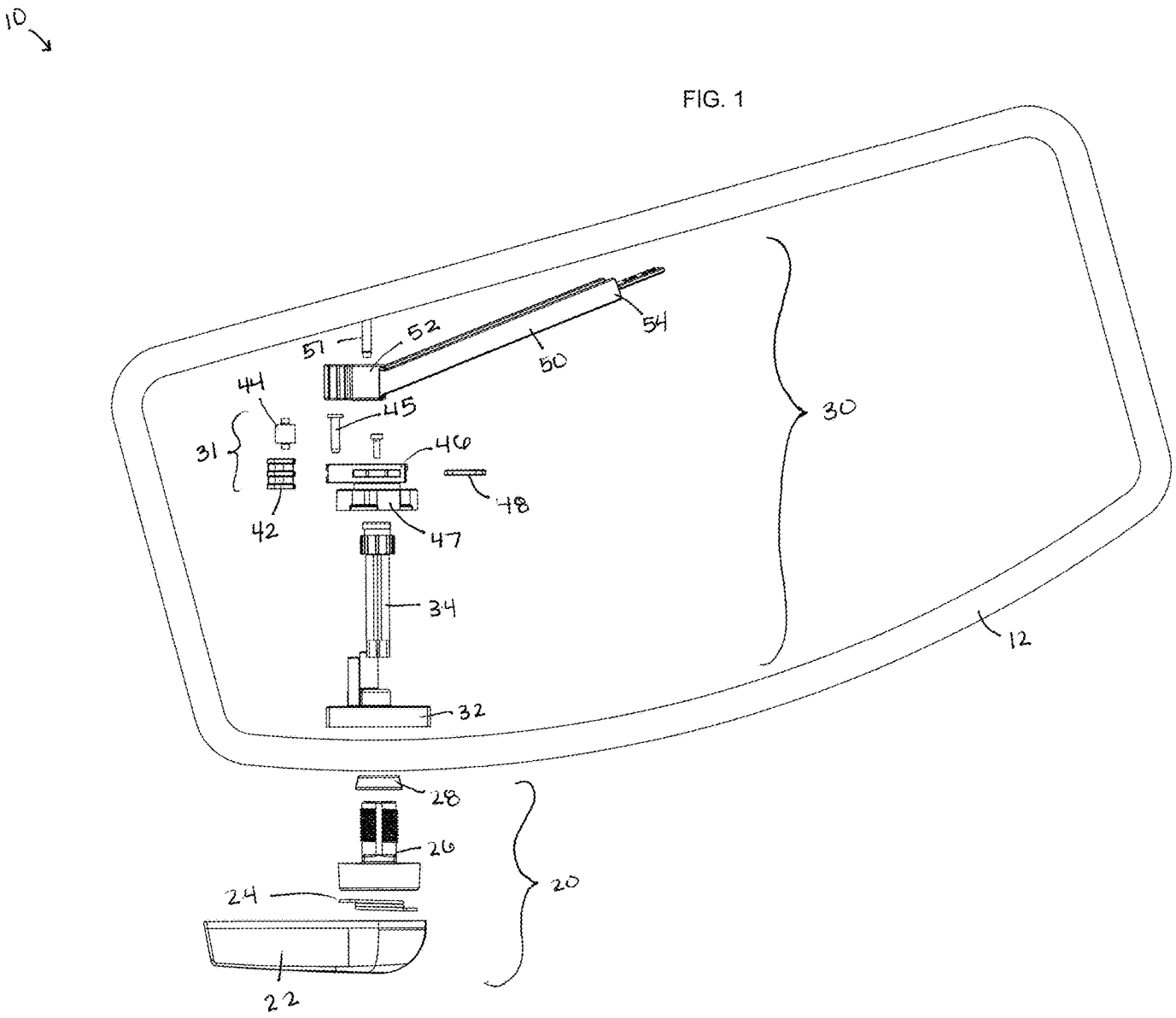
FIG. 1 is a top plan view of a portion of a toilet tank showing the elements of the flush lever with clutch that is constructed in accordance with the present invention, the elements thereof being shown in exploded view, and one element thereof being a roller-driven timed cam.

Referring now to the drawings in detail, wherein like-numbered elements refer to like elements throughout, FIG. 1 is an example of a flush lever with clutch assembly, generally identified 10, consistent with the present disclosure. Assembly 10 includes an outer subassembly 20, a toilet tank 12, and an inner subassembly 30. As shown in FIG. 1, outer subassembly 20 is located external to toilet tank 12, while inner subassembly 30 is located within toilet tank 12.

Outer subassembly 20 further comprises a handle 22 and a handle stop 26. A torsion spring 24 is disposed between handle 22 and handle stop 26. As used herein, a torsion spring refers to a particular variety of spring that functions through twisting of the end(s) of the spring along the spring's axis. When twisted, a torsion spring, such as torsion spring 24, exerts a torque in the direction opposite the twisting, allowing mechanical energy to be stored within the spring itself. In the case of torsion spring 24, the end is twisted when handle 22 is depressed or pushed down (i.e., when the toilet is flushed). This stores mechanical energy within torsion spring 24, which will be used to return the handle 22 to its neutral or home position. This process is discussed further herein with respect to FIGS. 4-6.

The outer subassembly 20 is coupled to toilet tank 12 at a tank hole (not shown in FIG. 1). The tank hole is generally square in shape so as to allow for a handle, such as handle 22, to be positioned in a variety of ways. Once handle 22, as well as torsion spring 24 and handle stop 26, are position at a location and in a way that the user prefers, a tank hole seal 28 is installed. As used herein, a tank hole seal refers to a small sealing device that helps seal the tank hole so that water does not escape during movement of the handle 22.

The inner subassembly includes a mounting plater 32 and a drive pin 34. Mounting plate 32, when assembled, is located flush to an inner wall of the toilet tank 12 and assists in providing spacing between the inner subassembly 30 and outer subassembly 20, as well as being able to receive and hold additional components. One such additional component received by the mounting plate 32 is a drive pin 34. Drive pin 34 extends perpendicularly outward from the mounting plate 32, such that the drive pin 34 extends away from the inner wall of the toilet tank 12.

A flush lever 50 is further coupled to the mounting plate 32. As described previously, flush lever 50 is used to open and close the flapper or canister disposed within the toilet tank, often by a chain, although other methods may be used. The proximal end 52 of flush lever 50 is coupled to the mounting plate 32 by a retaining pin 51. In this way, the flush lever 50 is mechanically coupled to the handle 22, such that when the handle 22 is depressed, the flush lever 50 will rotate about the retaining pin 51 at the proximal end 52. The distal end 54 of the flush lever 50 is the end that is coupled to the flapper or canister (not shown in FIG. 1), and will rotate upwards, or counterclockwise, when the handle 22 is depressed.

The inner subassembly 30 further includes a roller subassembly 31. The roller subassembly 31 is disposed between the drive pin 34 and the flush lever 50, such that the roller subassembly 31 is coupled to both the flush lever 5 and the drive pin 34, and thus is also mechanically connected with the handle 22 and the rest of outer subassembly 20. Roller subassembly 31 includes a push rod 42, a roller 44, a binder pin 45, a clutch release mount 46, a lock nut 47, and a retaining clip 48. These elements are discussed further herein with respect to FIGS. 2-3.

Figure 2:
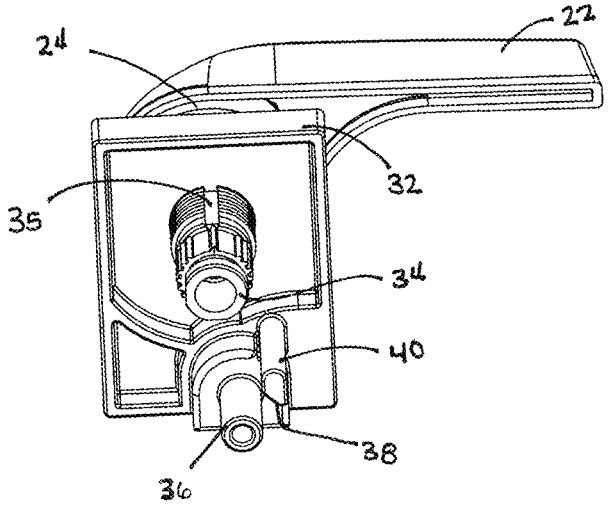
FIG. 2 is an example of the flush lever assembly consistent with the present disclosure.

FIG. 2 is an example of the flush lever assembly consistent with the present disclosure. As discussed with respect to FIG. 1, the handle 22 is disposed external to a toilet tank (not shown in FIG. 2), with a torsion spring 24 disposed between handle 22 and the toilet tank. Mounting plate 32 receives a drive pin 34, which is in turn coupled to handle 22 and the outer subassembly discussed with respect to FIG. 1. Drive pin 34 includes a polarizing structure 35 to allow for proper positioning and alignment of the mounting plate 32.

A flush lever post 36 is disposed beneath drive pin 34 and extends outwardly from mounting plate 32. Flush lever post 36 is designed to receive a flush lever, such as flush lever 50, discussed with respect to FIG. 1, with flush lever 50 being held in place by a retaining pin. A lever down stop 38 is located next to flush lever post 36 and serves to limit the distance that a flush lever is able to rotate or travel downward. Finally, a mounting plate kick ledge 40 is disposed above the flush lever post 36 and the lever down stop 38.

Figure 3:
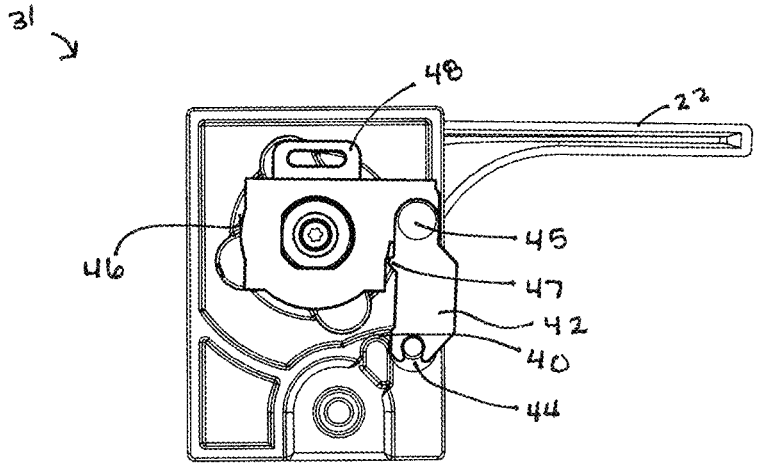
FIG. 3 is an example of the roller subassembly of FIG. 1 consistent with the present disclosure.

FIG. 3 is an example of the roller subassembly 31 of FIG. 1 consistent with the present disclosure. Roller subassembly 31 includes a kick ledge 40 which, when roller subassembly 31 is actuated, interacts with the roller itself (this process is discussed further herein with respect to FIGS. 4-6). Roller subassembly 31 further includes a push rod 42 and a roller 44. The push rod 42 includes a push rod kick ledge 47. As used herein, a kick ledge refers to a protrusion extending outwardly from a structure that is designed to come in contact with or couple with a corresponding structure.

Roller 44 is coupled to push rod 42, and may be coupled through a snap fit (i.e. roller 44 may be snapped into the push rod 42), although examples are not so limited. As shown in FIG. 3, the roller 44 may extend downwardly from push rod 42, with a portion of roller 44 extending past the lower end of push rod 42. This may allow roller 44 to rotate or otherwise move with respect to push rod 42, as well as with respect to other components of the flush lever assembly.

A clutch release mount 46 is coupled to the drive pin 34. As used herein, a clutch release mount refers to a cogged and polarized piece that, when coupled with a drive pin such as drive pin 34, rotates at a particular rate over a particular distance. Clutch release mount 46 may be coupled to the drive pin 34 by a retaining clip 48. As used herein, a retaining clip refers to a generally U-shaped or semicircular clip sized to selectively hold and lock two pieces of material together. When handle 22 is depressed, clutch release mount 46 may rotate with drive pin 34.

Push rod 42 may be coupled to timed released mount 46 by a binder pin 45. Binder pin 45 may rotate such that push rod 42, as well as roller 44 (which is coupled thereto) may move downwardly when handle 22 is depressed. That is, push rod 42 may be coupled to clutch release mount 46 to allow the push rod 42, as well as roller 44, to move when the clutch release mount 46 rotates with the drive pin 34. The movement of these components is discussed further herein with respect to FIGS. 4-8.

Figure 4:
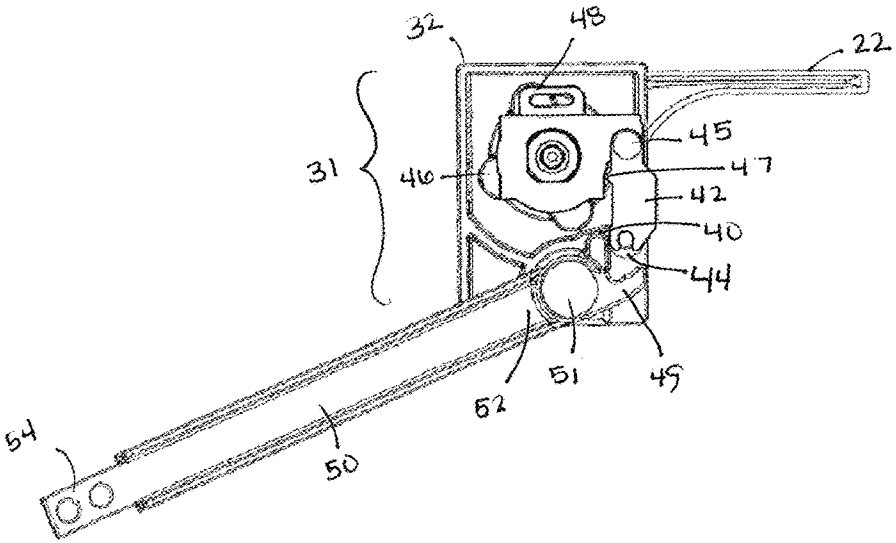
FIG. 4 is an example of the flush lever assembly consistent with the present disclosure.

FIGS. 4-9 show an example of the flush lever assembly consistent with the present disclosure as in use. FIG. 4 shows the flush lever assembly with handle 22 in the neutral or home position. Flush lever 50 is coupled to mounting plate 32 at a plate 32 at a proximal end by a retaining pin 51; distal end 54 of flush lever 50 extends downwardly and away from the mounting plate 32. Roller subassembly 31 is coupled to mounting plate 32 above flush lever 50. As shown in FIG. 4, clutch release mount 46 is located centrally in the mounting plate, coupled to the drive pin (not shown) by retaining clip 48. Push rod 42 is coupled to clutch release mount 46 by a binder pin 45; roller 44 is coupled to push rod 42 and is disposed above a flush lever ramp 49.

Figure 5:
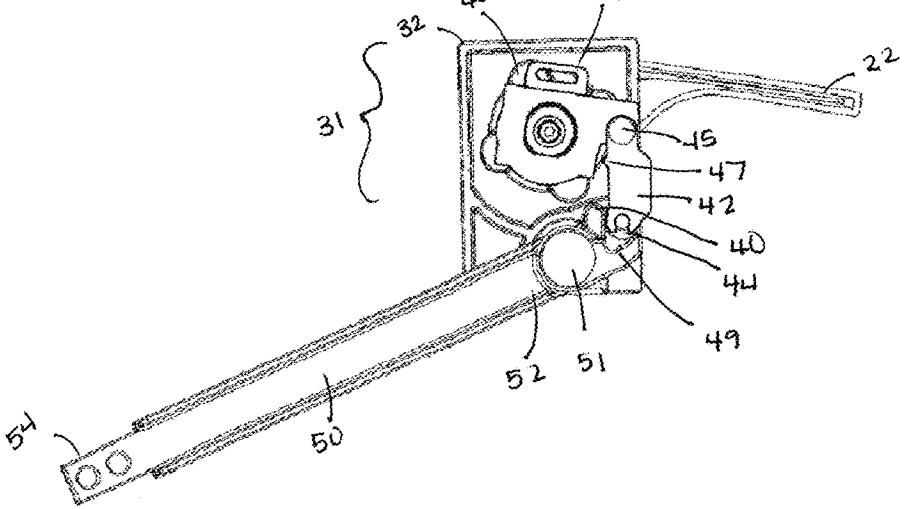
FIG. 5 is an example of the flush lever assembly shown in FIG. 4 consistent with the present disclosure.

FIG. 5 shows the flush lever assembly with the handle 22 beginning to be depressed (i.e., moving into the "flush" position). Clutch release mount 46 has begun to rotate away from the home position (shown in FIG. 4), causing push rod 42 to begin to move downwardly. As a result, roller 44 is moving closer to flush lever ramp 49, although at the stage of handle 22 depressing shown in FIG. 5, roller 44 has not yet made contact with flush lever ramp 49.

Figure 6:
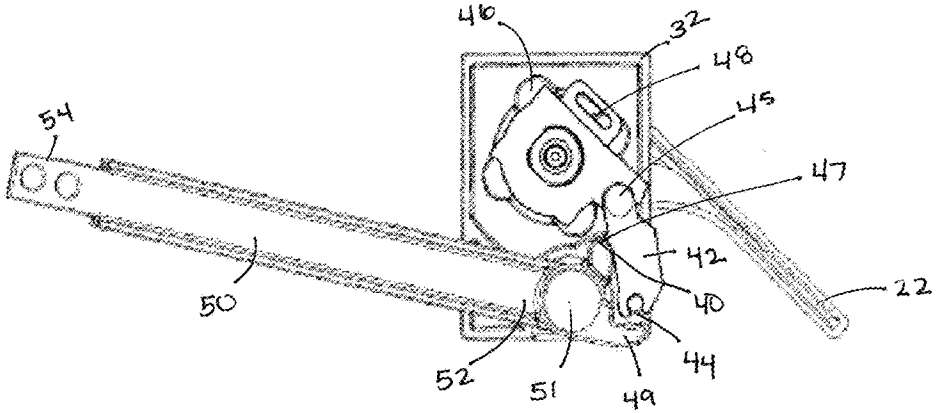
FIG. 6 is an example of the flush lever assembly shown in FIG. 4 consistent with the present disclosure.

FIG. 6 shows the flush lever assembly with the handle 22 depressed (i.e., in the "flush" position). As can be seen in FIG. 6, flush lever 50 has rotated about the proximal end 52 at retaining pin 51, causing distal end 54 of flush lever 50 to raise or rotate upward. This rotation would cause the flush lever 50 to lift the flapper or canister (not shown) to which the flush lever 50 is attached.

In addition, depression of the handle 22 causes rotation of the torsion spring included within the outer subassembly, discussed with respect to FIG. 1. As described with respect to FIG. 1, rotation of the torsion spring puts mechanical energy into the spring. In addition, clutch release mount 46 rotates about the drive pin with the rotation of the torsion spring.

Rotation of the clutch release mount 46 further causes downward movement of the push rod 42. As discussed with respect to FIGS. 3-4, the push rod 42 is coupled to clutch release mount 46 by a binder pin 45. With rotation of clutch release mount 46, push rod 42 moves downwardly, and will continue to move until push rod kick ledge 47 contacts mounting plate kick ledge 40. When push rod kick ledge 47 contacts the mounting plate kick ledge 40, roller 44 will be in contact with the flush lever ramp 49.

Figure 7:
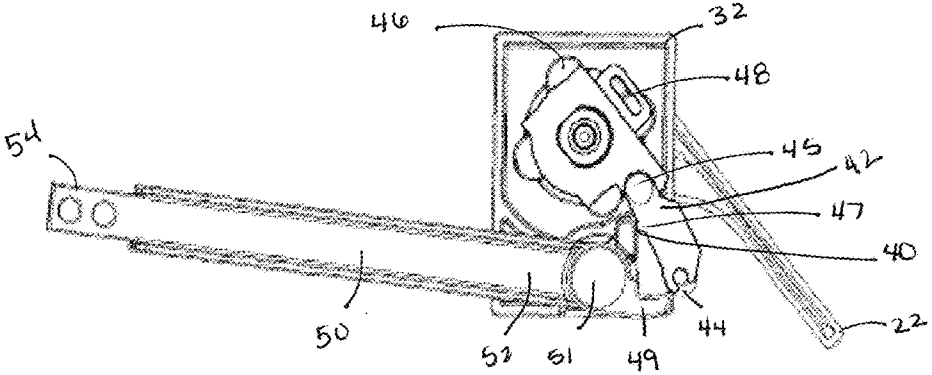
FIG. 7 is an example of the flush lever assembly shown in FIG. 4 consistent with the present disclosure.

FIG. 7 shows the flush lever assembly with the handle 22 fully depressed. As with FIG. 6, flush lever 50 has rotated about the proximal end 52 at retaining pin 51, with distal end 54 of flush lever 50 being raised. Clutch release mount 46 is fully rotated, as is the torsion spring contained within the handle (not shown). Push rod kick ledge 47 remains in contact with mounting plate kick ledge 40. However, as can be seen in FIG. 7, push rod 42 has continued to move outward, becoming more parallel to the clutch release mount 46. In the fully depressed position, roller 44 has come off flush lever ramp 49; that is, roller 44 breaks contact with the flush lever ramp 49.

Figure 8:
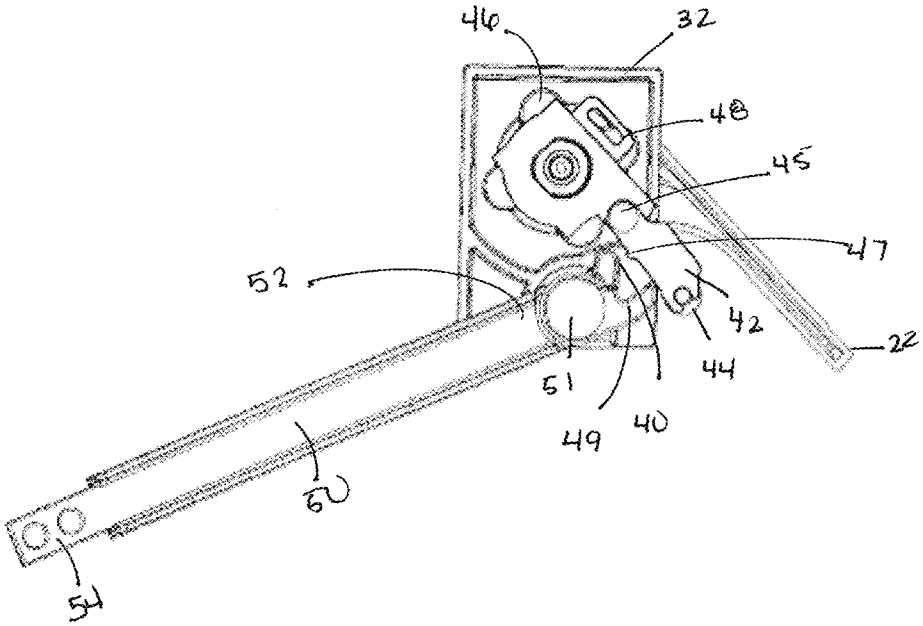
FIG. 8 is an example of the flush lever assembly shown in FIG. 4 consistent with the present disclosure.

FIG. 8 shows the flush lever assembly with the handle 22 fully depressed and beginning to move back to the home position. As shown in FIG. 8, flush lever 50 has rotated back to the home position (shown in FIGS. 4-5). However, clutch release mount 46 remains fully rotated, and push rod 42 has reached its full extension. In this position, roller 44 has come completely off flush lever ramp 49, with flush lever ramp 49 now contacting push rod 42. In addition, push rod kick ledge 47 has broken contact with mounting plate kick ledge 40. It is from this position that, upon release of the handle 22, the assembly 10 will return to its home position.

Upon release of the handle 22, the torsion spring contained therein uses the stored mechanical energy from being rotated and torqued to return the handle 22 to its neutral or home position. This is accomplished by rotating the drive pin, and the components coupled thereto, back. As shown in FIGS. 3-6 in particular, the clutch release mount is cogged, with the result that the clutch release mount moves at a specific and predetermined rate. Thus, when rotated using the mechanical energy of the torsion spring, the clutch release mount will move slowly and smoothly, returning the handle 22 to its home positon and the roller subassembly back into place.

In the foregoing detailed description of the present disclosure, reference is made to the accompanying drawings that form a part hereof, and in which are shown by way of illustration how examples of the disclosure may be practiced. These examples are described in sufficient detail to enable those of ordinary skill in the art to practice the examples of this disclosure, and it is to be understood that other examples may be utilized and that process and/or structural changes may be made without departing from the scope of the present disclosure.

Elements shown in the various figures herein can be added, exchanged, and/or eliminated so as to provide a number of additional examples of the present disclosure. In addition, the proportion and relative scale of the elements provided in the figures are intended to illustrate the examples of the present disclosure and should not be taken in a limiting sense.

The invention claimed is:

1. An assembly, comprising:
- an outer subassembly, wherein the outer subassembly further comprises:
  - a handle;
  - a handle stop;
  - a torsion spring disposed between the handle and the handle stop; and
  - a tank hole seal;
- a toilet tank; and
- an inner subassembly, wherein the inner subassembly further comprises:
  - a mounting plate to receive the outer subassembly;
  - a drive pin coupled to the mounting plate;
  - a mounting plate kick ledge;
  - a flush lever;
  - a flush lever retaining pin;
  - a flush lever ramp; and
  - a roller subassembly, wherein the roller subassembly further comprises:
    - a push rod;
    - a push rod kick ledge;
    - a roller coupled to the push rod;
    - a binder pin;
    - a clutch release mount coupled to an end of the drive pin; and
    - a retaining clip coupled to the clutch release mount and the drive pin.

2. The assembly of claim 1, wherein the clutch release mount is cogged and polarized such that the clutch release mount rotates at a particular rate over a particular distance.

3. The assembly of claim 2, wherein:
- the clutch release mount rotates to a home position at a specific and predetermined rate, wherein the specific and predetermined rate depends on the cog of the clutch release mount; and
- the clutch release mount is rotated using energy stored in the torsion spring.

4. The assembly of claim 2, wherein:
- the clutch release mount rotates away from a home position when the handle is depressed;
- the roller moves downwardly with the push rod when the clutch release mount is rotated such that the roller contacts the flush lever ramp; and
- the flush lever rotates about a proximal end thereof at the retaining pin.

5. The assembly of claim 4, wherein the torsion spring rotates when the handle is depressed.

6. The assembly of claim 5, wherein the torsion spring returns the handle to a home position when the handle is released.

7. The assembly of claim 5, wherein the handle is returned to the home position by rotation of the drive pin.

8. The assembly of claim 5, wherein:
- the push rod kick ledge contacts the mounting plate kick ledge when the handle is fully depressed and the clutch release mount is fully rotated; and the roller breaks contact with the flush lever ramp when the handle is fully depressed and the clutch release mount is fully rotated.

9. The assembly of claim 8, wherein:

the flush lever ramp contacts the push rod; and the push rod kick ledge breaks contact with the mounting plate kick ledge.

* * * * *